United States Patent [19]

Litz

[11] Patent Number: 4,633,529

[45] Date of Patent: Jan. 6, 1987

[54] BASEBALL SHIN GUARDS

[76] Inventor: Steven D. Litz, P.O. Box C, Buffalo, Okla. 73834

[21] Appl. No.: 697,213

[22] Filed: Jan. 31, 1985

Related U.S. Application Data

[63] Continuation-in-part of Ser. No. 656,704, Oct. 1, 1984, abandoned.

[51] Int. Cl.[4] ..... A41D 13/00

[52] U.S. Cl. ..... 2/22; 2/24

[58] Field of Search ..... 2/22, 23, 24, 2, DIG. 6; 128/80 B, 80 C, DIG. 15, 80 R

[56] References Cited

U.S. PATENT DOCUMENTS

| | | | |
|---|---|---|---|
| 1,624,129 | 4/1927 | Barrett | 2/22 |
| 2,982,968 | 5/1961 | Groot | 2/22 |
| 3,592,189 | 7/1971 | Berger | 128/DIG. 15 |
| 3,786,804 | 1/1974 | Lewis | 2/24 |
| 3,845,769 | 11/1974 | Shaw | 128/DIG. 15 |
| 4,041,940 | 8/1977 | Frankel et al. | 128/80 C |
| 4,361,912 | 12/1982 | Arthur | 2/22 |
| 4,481,682 | 11/1984 | Hall | 2/DIG. 6 |
| 4,490,855 | 1/1985 | Figgie, III et al. | 2/24 |

*Primary Examiner*—Louis K. Rimrodt
*Assistant Examiner*—Joseph S. Machuga
*Attorney, Agent, or Firm*—Laney, Dougherty, Hessin & Beavers

[57] ABSTRACT

Combination apparatus for baseball shin guards of a quick-release type wherein the conventional shin guard consisting of instep, shin, knee and/or thigh protector portions is secured in position by means of a plurality of straps having pressure adhesive fasteners. Thus, of a plurality of leg securing straps, each consists of one or more elongatable straps hingedly secured to opposite sides of the shin guard and including such as VELCRO-type securing tabs for rapid affixture and/or release.

3 Claims, 7 Drawing Figures

BASEBALL SHIN GUARDS

CROSS-REFERENCE TO RELATED APPLICATION

The present application is a continuation-in-part of U.S. patent application Ser. No. 656,704 as filed on Oct. 1, 1984 and entitled "IMPROVED BASEBALL SHIN GUARDS", abandoned.

BACKGROUND OF THE INVENTION

1. Field of the Invention

The invention relates generally to shin guards of the type used at the catcher position in baseball and, more particularly, but not by way of limitation, it relates to an improved shin guard that includes quick-connect securing straps.

2. Description of the Prior Art

The prior art includes a great number of applications in sporting goods wherein protective padding and other appendant articles are secured to clothing and the like by means of VELCRO-type fasteners. For example, there are various teachings of affixure of padding within hockey garments using VELCRO affixure to the inside of outer garments. Accordingly, such similar usage is to be found variously with respect to many forms of sporting gear, uniforms and the like. The only prior teaching known relative to shin guard equipment is U.S. Pat. No. 3,465,364 in the name of Edelson which teaches a soccer-type shin guard bearing a VELCRO strip for affixure to the inside of the player's knee-length stocking. Such soccer shin padding has traditionally been in the form of a shell shape to fit the shin bone and insertable within the player's stocking. The Edelson patent merely adds a VELCRO strip for aid in maintaining constant position of the shin guard during active movement by adhesion to the stocking. Thus, and as is similar to the total body of prior art located, the pressure adhesive substance is utilized only to maintain continual positioning of a pad or other garment addendum, and none of the prior teachings are directed to the VELCRO-type securing means as a quick-release securing member for equipment which must be repeatedly donned and removed during progress of play.

SUMMARY OF THE INVENTION

The present invention relates to improvements in baseball shin guards wherein the more or less conventional types of shin guards are utilized in combination with a plurality of quick-release securing straps that utilize the VELCRO-type pressure adhesive securing tabs. Thus, two or sometimes more VELCRO fastened securing straps are utilized at optimum locations along the shin guard and such combination of structure enables the catcher to remove or to don the shin guards in a fraction of the time normally required for the buckle-on shin guards of long-known and conventional type.

Therefore, it is an object of the present invention to provide a baseball shin guard that is more readily put on and/or removed by the catcher as is necessitated during an on-going baseball game.

It is also an object of the present invention to provide an improved combination shin guard with securing elements that is simple and reliable in operation.

Finally, it is an object of the present invention to provide an improved baseball shin guard that tends to shorten game time through avoidance of unnecessary delays.

Other objects and advantages of the invention will be evident from the following detailed description when read in conjunction with the accompanying drawings which illustrate the invention.

DETAILED DESCRITPION OF THE INVENTION

Figure 1:
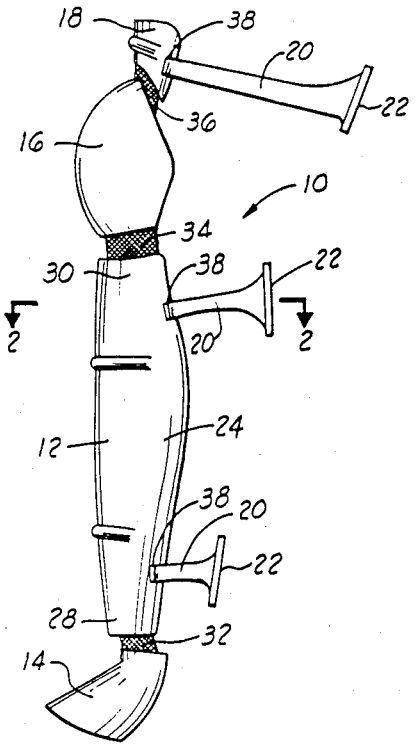
FIG. 1 is a side view in elevation of one form of baseball shin guard constructed in accordance with the present invention.

Referring to FIG. 1, a baseball shin guard 10 consists of interlinked sectors of leg padding that may be tightly secured along the lower leg extremities. Shin guard 10 may include such as a shin plate 12 hingedly connected to a lower instep plate 14, and also hingedly connected at the upper end to a knee plate 16. The knee plate 16 may also include a further hingedly connected thigh panel 18. Shin guard 10 is then secured about the legs by a plurality of securing straps 20, each sized for tight affixure about the leg and each including a pressure adhesive quick-release securing tab 22.

The shin plate 12 is shaped to cover the player's shin from ankle to below the knee and consists of opposite sides 24, 26 and lower and upper arcuate ends 28, 30. The instep plate 14, shaped to cover the instep in complete protection, is hingedly sewn or riveted to a pliable underliner portion 32 and, in like manner, kneecap plate 16 is hingedly connected by sewing or riveting to a pliable underliner portion 34 at the upper portion 30 of shin plate 12. When included, the thigh panel 18 is hingedly connected via an underliner portion 36 as sewn or riveted between panel 18 and kneecap plate 16, and panel 18 is spaced to allow flexure movement of the leg. The plate and panel portions 12, 14, 16, 18 may be formed by molding from such as phenolic resins or other of selected plastic materials. The pliable material constituting the underliner may be formed from any of selected plastics, leather or other elastomer materials.

Figure 2:
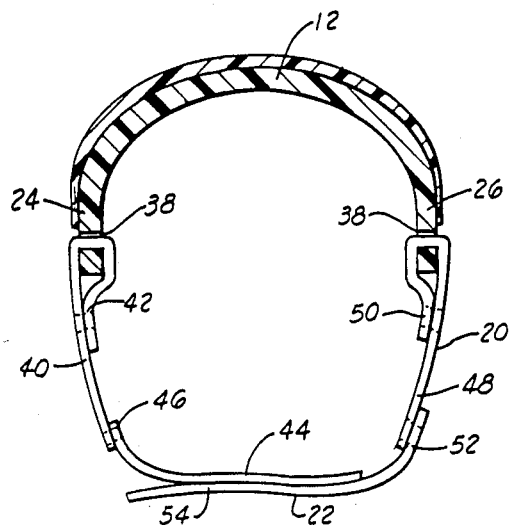
FIG. 2 is a section taken along lines 2—2 of FIG. 1.

The securing straps 20 may be secured on opposite sides of the plates or panels by sewing or riveting or, as shown, they may be secured as looped through slots 38 placed as needed. Referring also to FIG. 2, the securing strap 20 consists of a first strap 40 that is secured as extended through a respective slot 38 as the end is secured by stitching 42. The opposite end of first strap 40 is then secured to a securing tab 44 as by stitching 46. The remaining portion of securing strap 20, second strap 48 is similarly constructed as a loop is retained within the opposite slot 38 and secured as by stitching 50 while the remaining end is secured by stitching 52 to the securing tab 54. The tabs 48 and 54 constitute a pressure adhesive securing combination and these may be constituted of VELCRO-type material or similar pressure responsive medium. A plurality of such securing straps 20 may be utilized, generally in the manner as illustrated in FIG. 1. These being the optimum locations for secure affixure while causing minimum interference with limb movement.

Figure 3:
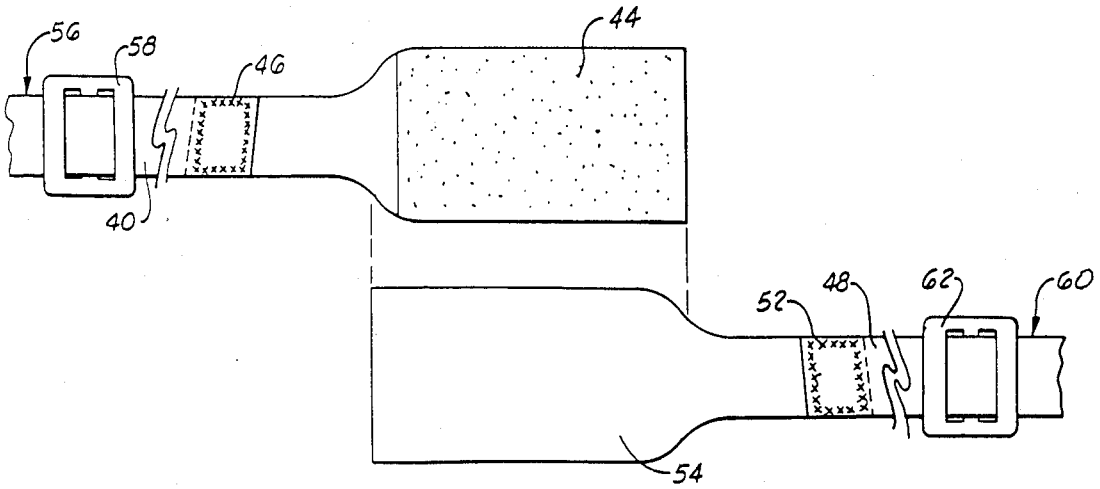
FIG. 3 is a plan view in offset relationship of first and second straps of a securing strap constructed in accordance with the present invention.

FIG. 3 illustrates a securing strap combination that includes certain adjustment features. Thus, the first strap 40 is formed to form a loop 56 and then re-insert into a buckle 58 to allow adjustment of the length between loop 56 and stitching 46. In like manner, the second strap 48 forms a loop 60 as adjustably positioned under control of buckle 62. The pressure adhesive tabs 44 and 54 may be formed of a commercially available type of VELCRO material, preferably of the heavier denier or weight and texture of material in order to better withstand the rigors of application.

In operation, the shin guard 10 offers many advantages in the way of quick, reliable affixure in donning and positioning the shin guards as well as quick release and removal during those periods when the catcher must strive for greatest mobility. Thus, batting or base running, the catcher must remove his shin guards and, when this sequence takes place at or near the end of an inning as, for example, when an unexpected number of batters has appeared, much extra time can be taken when the catcher has to contend with removal or adjustment of his gear. Cumulatively, much time can be saved over the extent of a nine-inning baseball game. This is especially true with regard to amateur sports, and such quick-release shin guards would be particularly desirable in little league and other junior applications.

Figure 4:
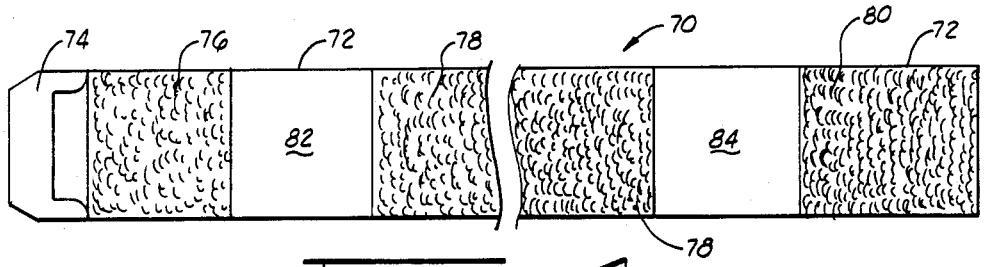
FIG. 4 is a plan view of an alternative form of securing strap as utilized in the present invention.
Figure 5:
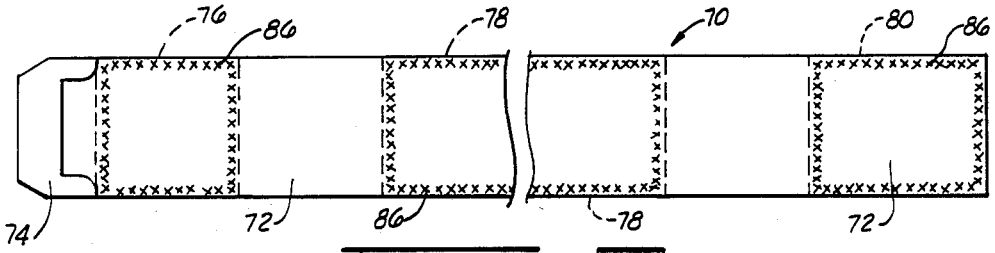
FIG. 5 is a plan view of the opposite side of the securing strap of FIG. 4.

FIGS. 4 and 5 illustrate an improved form of securing strap 70 that is capable of varied applications in combination with nearly all types of shin guard. Thus, either four-strap or three-strap shin guards may utilize securing straps 70, albeit that the length may vary, so long as the shin guard includes the conventional securing holes, i.e. either D-rings, formed slots or the like.

Securing strap 70 is formed of a basic elongated strip of elastic strap 72 of selected length and width. Length will be dictated by the position along the leg at which the strap is employed and dimensions will vary as between adult and junior models. One or both ends, may include a metal or consolidated tip, smoothly rounded to enable ready ring insertion during donning of the shin guard. The metal tips 74 are of well-known type as used on canvas belting or the like and may be readily stamped onto the strap ends. Alternatively, some synthetic elastic materials lend themselves to heat hardening of the tip ends.

A plurality of VELCRO material pads are disposed in secure affixure along the length of elastic strap 72. Thus, a VELCRO pad 76 of selected length is secured adjacent metal tip 74 to serve as the final securing tab. A larger strip of VELCRO pad 78 is secured generally across the center portion of elastic strap 72 and a VELCRO pad 80 is affixed on the remaining end of elastic strap 72. The VELCRO material may be one of the conventional types of hooks/holes or hooks/hooks types, the primary criterion being firmness of affixure and holding strength.

Expanses of the elastic strap 72, such as portions 82 and 84, remain free of the VELCRO pads in order to accommodate the necessary elongation stretching, the length of void spaces 82 and 84 being proportional to the requisite stretchability. In present assembly, the individual VELCRO pads 76, 78, 80 or more are first glued onto the elastic strap 72 and then stitched in order to provide maximum strength and reliability. Note stitches 86 as shown in FIG. 5. As a general rule, the mid-portion pad 78 spans a greater length than end pads 76 and 80 albeit that the total length of straps 70 will vary in accordance with point of application, i.e. ankle, calf, etc., and senior versus junior sizes.

Figure 6:
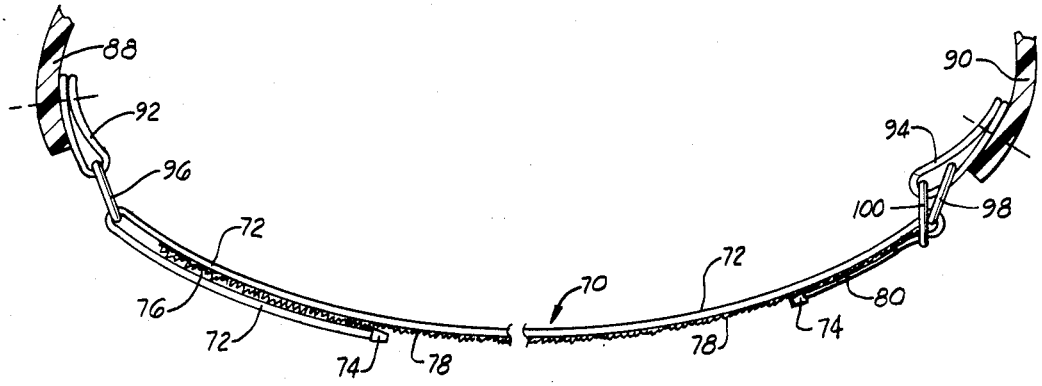
FIG. 6 is a side view of a securing strap shown in the fastened position between opposite sides of a shin guard, as shown in partial section.

FIG. 6 illustrates a securing strap 70 as functioning in operative position in support of a shin guard shown by opposite side portions 88 and 90. This type of shin guard is a commercially available form which extends opposite side fabric yokes 92, 94 as riveted or otherwise fastened to the respective shin guard opposite sides 88 and 90 in order to support D-rings. The closure side yoke 92 supports a single D-ring 96 which functions to receive the tip end 74 of securing strap 70 to secure the shin guard in operative position. The opposite side yoke 94 may include two D-rings 98 and 100 in order to more permanently receive the remaining end of securing strap 70 while retaining the strap on the shin guard in both operative and inoperative attitudes. Thus, D-ring 98 provides a securing affixure to strap 70 while D-ring 100 provides a locking ring as it continually bears against the remaining outer end of securing strap 70 to maintain VELCRO pad 80 in affixure to some portion of VELCRO pad 78. The securing strap 70 is similarly affixed on the removable side by drawing the strap tightly through D-ring 96 and looping securing strap 70 back to engage VELCRO pad 76 in whatever mating portion of VELCRO pad 78.

The VELCRO strap 70 can be utilized with any of the various types of shin guard so long as they utilize some type of hole or void on opposite sides of the structure for fastening of the strapping or buckling assembly. This encompasses nearly all known types of shin guard and a securing strap of the present design is readily adaptable with any. The total area of VELCRO affixure material at each of the various positions may be varied in accordance with the exigencies of design, i.e. size and age of player participant and the rigors of participation. Many variations are possible such as the inclusion of the buckle-type affixure assembly of FIG. 3 at one end of the strap in combination with the narrower tip 74 end as shown in FIGS. 4 and 5.

Figure 7:
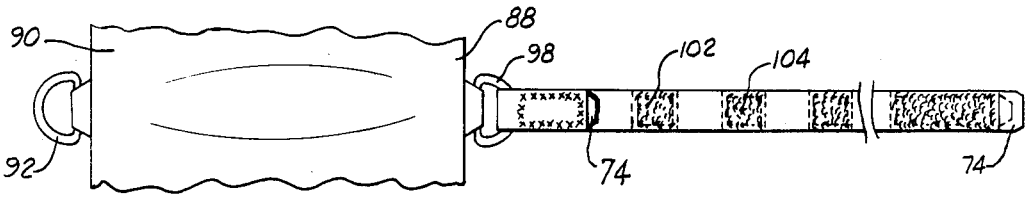
FIG. 7 is a front view in layout showing a portion of shin guard and a securing strap in open position.

FIG. 7 illustrates a variation wherein the main or central VELCRO pad 78 (FIG. 4) is broken up into segments 102, 104, etc. in order to increase the area of free elastic and thus the elongation resilience.

The foregoing discloses a novel quick-release elastic strap that is suitable for adaptation and use in combination with all existing baseball shin guard structures. The device may be readily secured by any of various securing structures, including buckle, rivets, VELCRO padding or the like, at one side of the shin guard, so long as the remaining tip end of the strap is readily securable by VELCRO engagement. Such securing capability enables much increased simplification and speed in donning equipment, procedures which are sometimes cumbersome and cause delay in playing time.

Changes may be made in combination and arrangement of elements as heretofore set forth in the specification and shown in the drawing; it being understood that changes may be made in the embodiments disclosed without departing from the spirit and scope of the invention as defined in the following claims.

What is claimed is:

1. An improved baseball shin guard capable of more rapid donning and removal, the combination comprising:

a shin guard consisting of an elongated shin plate having first and second sides and upper and lower ends with an upper plate and an instep plate hingedly affixed on respective upper and lower shin plate ends, and including at least one pair of securing means defining openings disposed on said first and second sides, said securing means defining openings consisting of first ring means hingedly affixed to said first side, and second ring means hingedly affixed to said second side and including parallel D-rings to enable relatively permanent fastening;

at least one unitary securing strap means consisting of an elongated strap having first and second strap ends with consolidated tip ends for operative insertion through respective first and second securing means openings, said first and second strap ends each having VELCRO® joinder pads secured thereon thereby to be releasably joinable to a coactive VELCRO® joinder pad secured on the mid-portion of said strap.

2. The combination of claim 1 which further includes:

at least one additional pair of oppositely disposed securing means defining openings secured on opposite sides of said upper plate; and at least one additional unitary securing means consisting of an elongated strap having first and second consolidated strap ends for operative insertion through respective opposite securing openings, said first and second strap ends including VELCRO® pads and being releasably joinable to the strap mid-portion by pressure adhesion.

3. The combination of claim 1 wherein:

said strap is elongatable elastic strip.

* * * * *